United States Patent [19]

Pizur, Sr.

[11] 4,019,744

[45] Apr. 26, 1977

[54] MULTIPLE BINGO GAME APPARATUS

[76] Inventor: Stephen J. Pizur, Sr., 905 Oak Ave., Barnesboro, Pa. 15714

[22] Filed: Jan. 5, 1976

[21] Appl. No.: 646,589

[52] U.S. Cl. ..... 273/135 B; 273/135 AC

[51] Int. Cl.[2] ..... A63F 3/06

[58] Field of Search ..... 273/130 B, 130 C, 135 B, 273/135 BC, 135 AC, 136 G, 135 R, 135 AD, 135 AA; 283/49, 50

[56] References Cited

UNITED STATES PATENTS

| | | | |
|---|---|---|---|
| 1,038,062 | 9/1912 | Albert | 273/135 BC |
| 2,368,896 | 2/1945 | Stewart | 273/130 B |
| 2,872,215 | 2/1959 | Taylor | 273/136 G |
| 3,169,769 | 2/1965 | Cornish | 273/135 B |
| 3,677,549 | 7/1972 | Moscovich | 273/135 R |
| 3,684,288 | 8/1972 | Grace | 273/135 AD |
| 3,747,926 | 7/1973 | Odom | 273/130 B |
| 3,814,435 | 6/1974 | Stratton | 273/135 B |

FOREIGN PATENTS OR APPLICATIONS

| | | | |
|---|---|---|---|
| 1,247,834 | 8/1967 | Germany | 273/135 B |

*Primary Examiner*—Richard C. Pinkham
*Assistant Examiner*—Harry G. Strappello
*Attorney, Agent, or Firm*—Clarence A. O'Brien; Harvey B. Jacobson

[57] ABSTRACT

A multiple bingo card for playing up to four bingo games simultaneously while only using a single card therefor. The arrangement of this card is such that what would normally constitute one space on such a card is divided into four quadrants which are color coded with the quadrants of all the other bingo spaces being correspondingly color coded. That is, all of the upper left hand corner quadrants of each conventional bingo space would be of one color, all the lower right corner quadrants being of another color, etc. A marker chip for use with the card may be of neutral or a contrasting color and in the form of a washer-like or doughnut-shaped disc. These discs will permit the color coding of the quadrants of the card as well as the number in the center thereof to be clearly visible. In another embodiment four sets of color coded chips are provided to enable the player to cover the corresponding colored quadrant with corresponding colored chips. Thus multiple bingo can be played on a single card instead of using up to four separate cards.

11 Claims, 3 Drawing Figures

Fig. 1
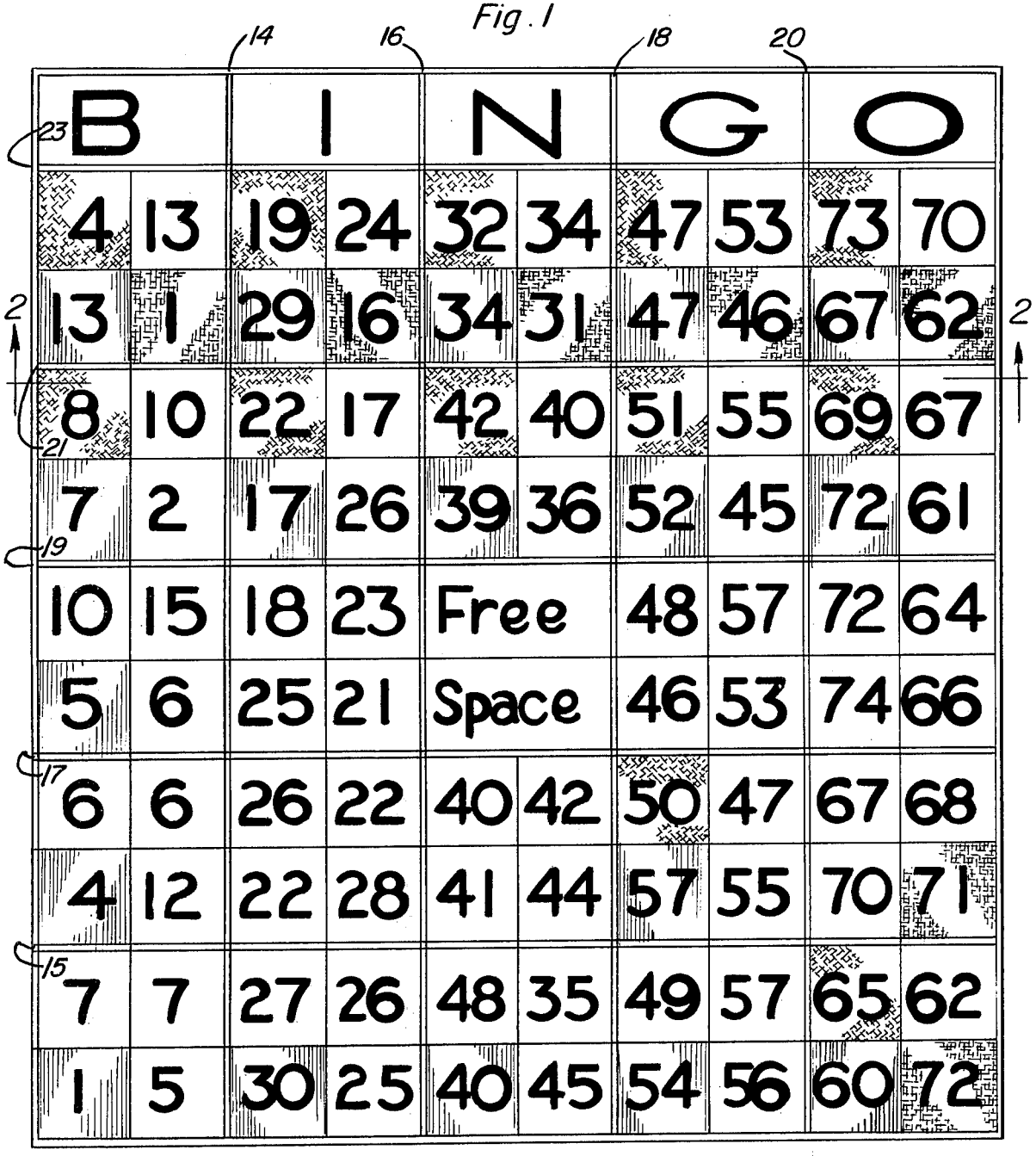
Fig. 2
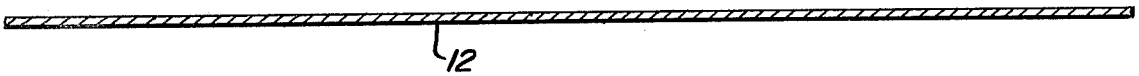
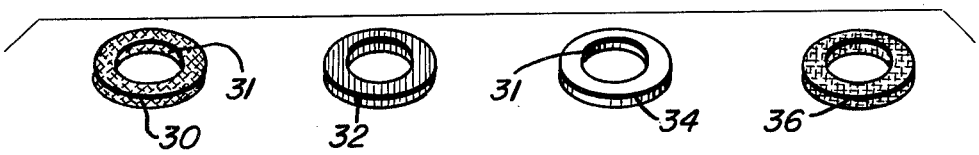
Fig. 3

MULTIPLE BINGO GAME APPARATUS

BACKGROUND OF THE INVENTION

1. Field of the Invention

This invention relates generally to the game of bingo and the cards and chips used to play said game.

2. Description of the Prior Art

A common problem with the average players of bingo is that when they try to play a number of bingo cards simultaneously it is sometimes quite difficult to do. There are limitations to physical space which is available because in order to properly play a number of cards simultaneously they must be spread out so all the blocks of each card cn be easily seen, and in crowded bingo parlors, church halls, etc., many times space available is quite limited. Also the scanning requirement necessary to look over a number of cards spread out on a table or chair becomes at times quite difficult. Also without the use of color coding sometimes playing a number of cards simultaneously becomes quite confusing. There are a number of prior art devices for games and educational devices which have multiple squares thereon and use a color code for identification purposes, but none of the prior art devices known to the applicant are for the purpose of playing multiple bingo as is the device of this invention. Prior patents which may be pertinent to this invention are as follows:

M. A. Bell Des. 106,958 Nov. 16, 1937, M. V. Wendland Des. 137,652 Apr. 11, 1944, J. Elliott 702,188 June 10, 1902, M. Maris 869,316 Oct. 29, 1907, E. A. Baker 2,806,702 Sept. 17, 1957, J. F. Weeks 3,549,150 Dec. 22, 1970.

SUMMARY OF THE INVENTION

An object of the present invention is to provide a multiple bingo card so that people may play more than one card of bingo at the same time.

Another object of this invention is to provide a multiple bingo card which is color keyed to corresponding color keyed playing markers in order to make it easy for a player to keep track of the four separate games which the person is playing.

A further object of this invention is to provide a multiple playing game device which will reduce the space requirements necessary for large groups of people playing said game.

A still further object of this invention is to provide marker discs having a hole in the center thereof to permit easy identification of the proper quadrant of the playing card after the disc is placed thereon.

Another further object is to provide marker discs of washer shape having either a neutral color, or a contrasting color, so as to avoid confusion with the colors used on the playing cards.

One of the big advantages of the multiple bingo card disclosed herein, is in the fact that each player need have only one card in order to play up to four games simultaneously. This permits a considerable saving in space requirements, and also simplifies the scanning required by each player in order to check the cards of the games the person is playing. Furthermore, the color coding of the game card disclosed herein enables the players to easily keep track of the separate games and facilitates the playing thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a plan view of the face of the multiple bingo card of this invention.

FIG. 2 is a cross section of the card taken generally along line 2—2 of FIG. 1.

FIG. 3 is a perspective view of the color coded playing chips having a central aperture therein.

DESCRIPTION OF THE PREFERRED EMBODIMENT

FIG. 1 of the drawings shows the face of the multiple bingo card of this invention. The card is constructed from material which is conventionally used for bingo cards such as cardboard, semi-flexible plastic, etc. The usual rectangular shape of approximately a ratio of 2/3 has reference to the top and sides, and preferably a slightly larger size then conventional cards is recommended.

Looking at FIG. 1, vertical divider lines 14, 16, 18, and 20 divide the face of the card into five equal portions. Starting at the bottom of the card a horizontal line 15 is provided of the same height as the width of the vertical spaces so that perfect squares are formed on the face of the card by the crisscrossing horizontal and vertical lines. Continuing upwardly four more horizontal lines 17, 19, 21, and 23 are provided so that a total of twenty-five perfect squares are delineated on the face of the card by the odd numbered horizontal lines and the even numbered vertical lines.

The small space remaining at the top of the card is appropriately inscribed, or printed or painted, with the name of the game "Bingo". The centermost space is appropriately indicated as a free space as is conventional with ordinary bingo cards. The remaining twenty-four squares are each divided into four quadrants with each quadrant being appropriately numbered and color coded. The numbers which are printed or otherwise applied to the respective quadrants would all be the same for a number of cards being made up, but obviously would be varied for various batches of cards. While the numbers may change from one batch of cards to another, preferably the color coding will remain constant so that users of the cards will become accustomed to the position by color and after playing a few games will automatically associate the various quadrants of each playing space with the corresponding appropriate color.

FIG. 2 of the drawing shows the card in cross section being of a thickness of one-sixteenth of an inch or so. The playing discs or markers 30, 32, 34, and 36 may be of the same size as conventional bingo markers or may be slightly reduced in size. An important feature of these markers is the fact that they have a central aperture or hole 31 therein (are washer or doughnut like) and are appropriately color coded to match the four color codes used for the cards. On the card and markers shown, all orange are used in the upper left hand corner quadrants with the marker 30 also being orange. All pink are used for the lower left hand corner quadrants with the marker or disc 32 being correspondingly pink. The upper right hand corner quadrants of each square are left white, or of the color (neutral) of the basic card stock used for the cards with the markers 34 also being of the same color. While all yellow is used for the lower right hand corner quadrants and for the marker disc 36. Thus it can be readily visualized how orange, pink, white and yellow contrast with each other and make it extremely simple for the players and users of the cards to play multiple bingo with an ease and simplicity never before available. Instead of markers 34 being white, or neutral in color, they may be made of a strongly contrasting color, such as dark green. Also all of the markers may be like the ones 34, i.e., neutral or of a dark color. In this case the markers 30, 32 and 36 would not be used.

Of course avid bingo players, once they become familiar with this multiple bingo card, very likely will increase their skills by playing several of these cards simultaneously which increases their playing potential tremendously. If sufficient room is available for four to six normal cards, by use of this new multiple bingo card such a player could increase his capacity by four times or so or up to sixteen to twenty-four games at one time. This in itself offers a challenge to extremely skilled bingo players never before available to them. Thus it can be seen that the mulitple bingo card and color coded marker discs disclosed herein open up new fields of skill and fun never before available to anyone before this invention.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An improved bingo game including; means for playing up to four games simultaneously on one card, means for marking the numbers called off by the game master for the individual games being played up to four without overlap or confusion by the players, the means for playing up to four games simultaneously on one card including a card with each of the usual twenty-four numbered squares divided into four quadrants and with each of the four quadrants within each square being appropriately numbered, and the four numbered quadrants of each square color coded differently from each other, and the same color coding is used for the corresponding quadrants in all of the other squares.

2. The game apparatus as set forth in claim 1 wherein one of the quadrants in a square is color coded orange and the corresponding quadrant in all the other squares are also colored orange.

3. The game apparatus as set forth in claim 1 wherein one of the quadrants in a square is color coded pink and the corresponding quadrant in all the other squares are also colored pink.

4. The game apparatus as set forth in claim 1 wherein one of the quadrants in a square is color coded yellow and the corresponding quadrant in all the other squares are also colored yellow.

5. The apparatus of claim 1 wherein the means for marking the numbers called off by the game master for the individual games up to four are marker discs each having a hole in the center thereof to permit easy viewing of the quadrants of the bingo card on which they are placed.

6. The apparatus of claim 5 including the marker discs being of a neutral color for less confusion of the players.

7. The apparatus of claim 5 including the marker discs being of a dark color which contrasts with the colors on the playing cards.

8. The game apparatus as set forth in claim 1 wherein the quadrants of each of the squares are color coded orange, pink, yellow, and white with the color coding of all the squares having their quadrants correspondingly color coded.

9. The game apparatus as set forth in claim 8 wherein the means for marking the numbers called off by the game master comprise marker discs of orange, pink, yellow, and white colors to correspond with the respective quadrants of each bingo square.

10. The game apparatus of claim 9 wherein the marker discs each have a center hole therein.

11. The game apparatus of claim 10 wherein the card further including a twenty-fifth square designated as a free space square.

* * * * *